US005360095A

United States Patent [19]

Speas

[11] Patent Number: 5,360,095

[45] Date of Patent: Nov. 1, 1994

[54] POWER CONSERVING ELECTRONIC PARKING METER

[75] Inventor: Gary W. Speas, Little Rock, Ark.

[73] Assignee: POM Incorporated, Russellville, Ark.

[21] Appl. No.: 864,479

[22] Filed: Apr. 7, 1992

[51] Int. Cl.[5] ..... G07F 17/24

[52] U.S. Cl. ..... 194/217; 194/317

[58] Field of Search ..... 194/215, 216, 217, 218, 194/302, 303, 317, 318, 319, 334, 902; 368/7, 90, 92; 340/51; 364/569

[56] References Cited

U.S. PATENT DOCUMENTS

| | | | |
|---|---|---|---|
| 2,656,908 | 10/1953 | Ellison | 194/279 |
| 2,807,016 | 9/1957 | Gloess | 342/142 |
| 3,166,732 | 1/1965 | Ljungman et al. | 340/932.2 |
| 3,373,856 | 3/1968 | Kusters et al. | 194/318 |
| 3,482,110 | 12/1969 | Robinson | 307/120 |
| 3,535,870 | 10/1970 | Mitchell | 368/6 |
| 3,541,308 | 11/1970 | Ruby | 235/378 |
| 3,575,586 | 4/1971 | Kroll | 235/378 |
| 3,667,485 | 6/1972 | Sesko | 194/207 |
| 3,760,160 | 9/1973 | Gieringer et al. | 235/378 |
| 3,776,338 | 12/1973 | Johnson | 194/244 |
| 3,876,865 | 4/1975 | Bliss | 235/492 |
| 3,909,826 | 9/1975 | Schildmeier et al. | 340/524 |
| 3,948,375 | 4/1976 | Selby, Jr. | 194/216 |
| 3,999,372 | 12/1976 | Welch et al. | 368/6 |
| 4,031,991 | 6/1977 | Malott | 194/217 |
| 4,034,193 | 7/1977 | Jackson | 364/465 |
| 4,080,598 | 3/1978 | Cardone | 340/683 |
| 4,228,519 | 10/1980 | Pfeifer | 364/564 |
| 4,231,458 | 11/1980 | Limone et al. | 194/211 |
| 4,249,648 | 2/1981 | Meyer . | |
| 4,275,272 | 6/1981 | Mennino, Jr. et al. | 379/112 |
| 4,310,890 | 1/1982 | Trehn et al. | 364/467 |
| 4,311,953 | 1/1982 | Fakuda et al. | 320/2 |
| 4,347,925 | 9/1982 | Sugimoto et al. | 194/200 |
| 4,356,903 | 11/1982 | Lemelson et al. | 194/217 |
| 4,375,662 | 3/1983 | Baker | 363/95 |
| 4,379,334 | 4/1983 | Feagins, Jr. et al. | 364/467 |
| 4,460,080 | 7/1984 | Howard | 194/317 |
| 4,474,281 | 10/1984 | Roberts et al. | 194/218 |
| 4,481,590 | 11/1094 | Otten | 364/479 |
| 4,483,431 | 11/1984 | Pratt | 194/317 |
| 4,566,803 | 1/1986 | Waniisi et al. | 368/66 |
| 4,568,877 | 2/1986 | Tinsley | 324/76.11 |
| 4,571,532 | 2/1986 | Jaster | 320/2 |
| 4,576,273 | 3/1986 | Milnes | 194/209 |
| 4,614,879 | 9/1986 | Ault | 307/130 |
| 4,634,953 | 1/1987 | Shoji et al. | 320/1 |
| 4,653,931 | 3/1987 | Takeda | 368/205 |
| 4,681,204 | 7/1987 | Zimmermann | 194/317 |
| 4,702,613 | 10/1987 | Ohtawa | 368/66 |
| 4,705,154 | 11/1987 | Masho et al. | 194/318 X |
| 4,712,923 | 12/1987 | Martin | 368/10 |
| 4,733,765 | 3/1988 | Watanabe | 194/206 |
| 4,754,862 | 7/1988 | Rawicz-Szczerbo et al. | 194/319 |
| 4,823,928 | 4/1989 | Speas | 194/217 |
| 4,827,206 | 5/1989 | Speas | 323/299 |
| 4,872,149 | 10/1989 | Speas | 368/90 |
| 4,880,097 | 11/1989 | Speas | 194/239 |
| 4,895,238 | 1/1990 | Speas | 194/319 |
| 4,967,895 | 11/1990 | Speas | 194/200 |
| 5,033,602 | 7/1991 | Saarinen et al. | 194/334 |
| 5,109,972 | 5/1992 | Van Horn et al. | 194/217 |
| 5,184,707 | 2/1993 | Van Horn et al. | 194/217 X |

FOREIGN PATENT DOCUMENTS 2077475 12/1981 United Kingdom .

*Primary Examiner*—Michael S. Huppert
*Assistant Examiner*—Scott L. Lowe
*Attorney, Agent, or Firm*—Hill, Steadman & Simpson

[57] ABSTRACT

A power conserving electronic parking meter system for receiving at least one type of payment element. The electronic parking meter has: a power source; a processor connected to the power source, the processor having at least an operational mode and a standby mode; apparatus for receiving the payment element and generating an interrupt request signal upon receipt of the payment element, the interrupt request signal being received by the processor which in response thereto changes from the standby mode to the operational mode; at least one apparatus for identifying the payment element and providing an identification signal to the processor indicative of the payment element, the apparatus for identifying having an active mode and a low-power mode, the apparatus for identifying receiving an enable signal from the processor when the processor changes from the standby mode to the operational mode, the enable signal causing the apparatus for identifying to change from the low-power mode to the active mode; and apparatus for displaying information connected to the processor, the apparatus for displaying having a reduced power display.

17 Claims, 11 Drawing Sheets

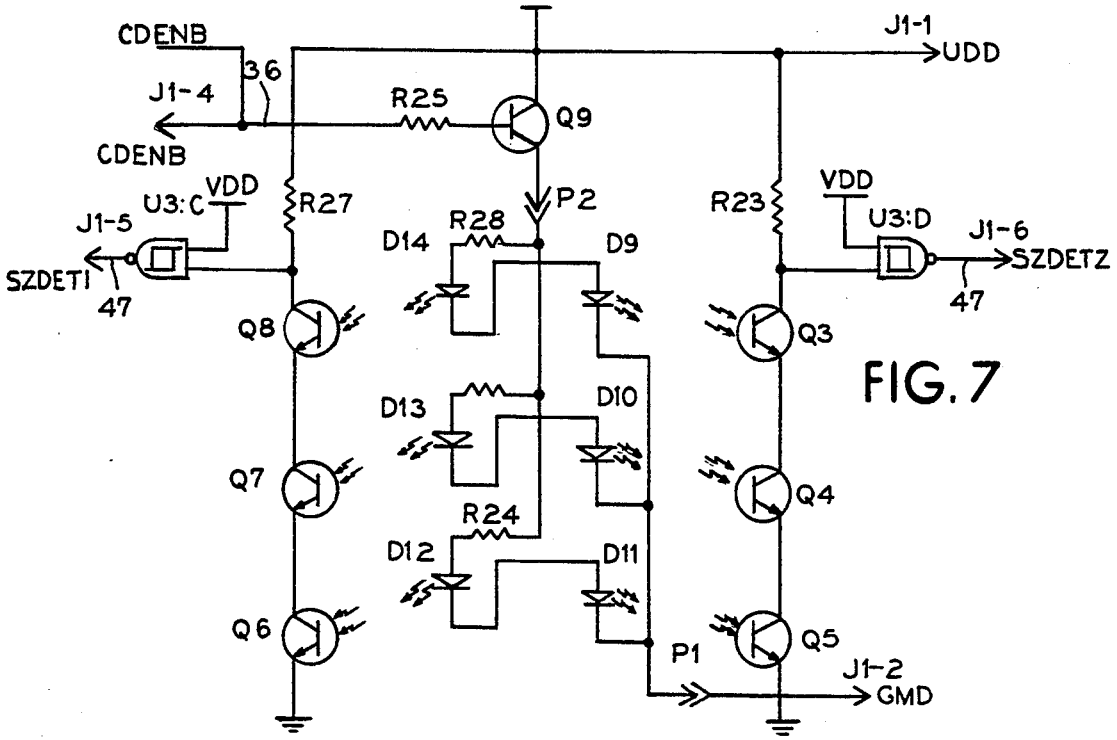
FIG. 7
FIG. 8
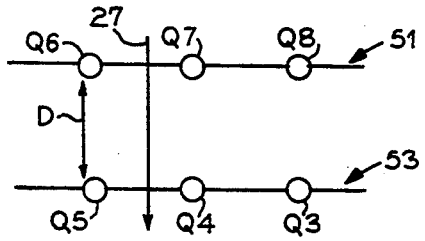
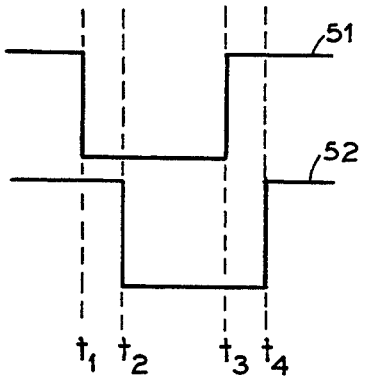
FIG. 9

POWER CONSERVING ELECTRONIC PARKING METER

BACKGROUND OF THE INVENTION

The present invention relates in general to electronic timing devices and electronic coin sensing devices and, in particular to electronic parking meters.

Both mechanical and electronic parking meters are known in the prior art and typically are responsive to the insertion of a coin to time an interval during which a vehicle is parked in an appropriate space associated with the parking meter. The timing interval is determined by the number and value of the coins which are inserted into the parking meter. Also, memory cards and smart cards may be used with electronic parking meters.

Since electronic parking meters must operate with batteries, solar power, or combinations thereof, the amount of power which the electronic parking meter uses is of prime importance in effective operation of the parking meter. The present invention provides an electronic parking meter which conserves power and places less power demands on the power source used with the electronic parking meter than in prior art parking meters.

SUMMARY OF THE INVENTION

It is an object of the present invention to provide an improved electronic parking meter which conserves power.

It is a further object of the present invention to provide an improved coin detection means in the electronic parking meter.

It is a further object of the present invention to provide an improved low power display for the electronic parking meter.

The present invention is an electronic parking meter system for receiving at least one type of coin or other payment device and includes means for conserving power.

In general terms the low power electronic parking meter system for receiving at least one type of payment element, comprises:

means for providing power;

means for processing connected to the means for providing power, the means for processing having at least an operational mode and a standby mode;

means for receiving the payment element and generating an interrupt request signal upon receipt of the payment element, the interrupt request signal being received by the means for processing which in response thereto changes from the standby mode to the operational mode;

at least one means for identifying the payment element and providing an identification signal to the means for processing indicative of the payment element, the means for identifying having an active mode and a low-power mode, the means for identifying receiving an enable signal from the means for processing when the means for processing changes from the standby mode to the operational mode, the enable signal causing the means for identifying to change from the low-power mode to the active mode; and means for displaying information connected to the means for processing, the means for displaying having means for reduced power display.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

FIG. 7 is a circuit diagram of the size detector circuit;

FIG. 8 is a diagram of the LED area detector of the size detector circuit;

FIG. 9 depicts the waveform signals that are output by the size detector circuit;

DESCRIPTION OF THE PREFERRED EMBODIMENT

The present invention has general applicability, but is most advantageously utilized in a parking meter for use within an associated space in which a vehicle may park. It is to be understood, however, that the present invention or portions thereof may be used for a variety of different applications whenever a paid timing function is to be utilized or whenever identification of deposited coins is required.

The following U.S. Patents disclose an electronic parking meter system and various components thereof. Each of the following patents is assigned to the same assignee as the present invention and each of the following patents is hereby incorporated by reference:

U.S. Pat. No. 4,823,928, "Electronic Parking Meter System";

U.S. Pat. No. 4,827,206, "Solar Power System For Electronic Parking Meter";

U.S. Pat. No. 4,872,149, "Electronic Advertising System For Solar Powered Parking Meter";

U.S. Pat. No. 4,880,097, "Park Card System For Electronic Parking Meter";

U.S. Pat. No. 4,895,238, "Coin Discriminator For Electronic Parking Meter"; and

U.S. Pat. No. 4,967,895, "Parameter Control System For Electronic Parking Meter".

The electronic parking meter of the present invention is designed to operate with either or both of coin sets for a particular country and memory cards or smart cards.

Memory and smart cards are known in the art and are typically shaped like credit cards. The cards have a memory unit which can interface with a microprocessor. The smart cards contain their own microprocessor. In the prior art, such cards are used to operate various types of payment devices, wherein a monetary value is subtracted from an initial monetary amount on the card. The electronic parking meter of the present invention interfaces with a 2KI2C card manufactured by Gemplus International which has a nonvolatile, electrically reprogrammable, floating gate NMOS memory (EEPROM). This particular card operates from one operating voltage of 5 volts and is utilized because of its low power dissipation characteristic.

The electronic parking meter of the present invention can recognize the particular coin set of the country in which it is used, as well as, subtracting monetary values from a memory card which is also receivable by the electronic parking meter.

Figure 1:
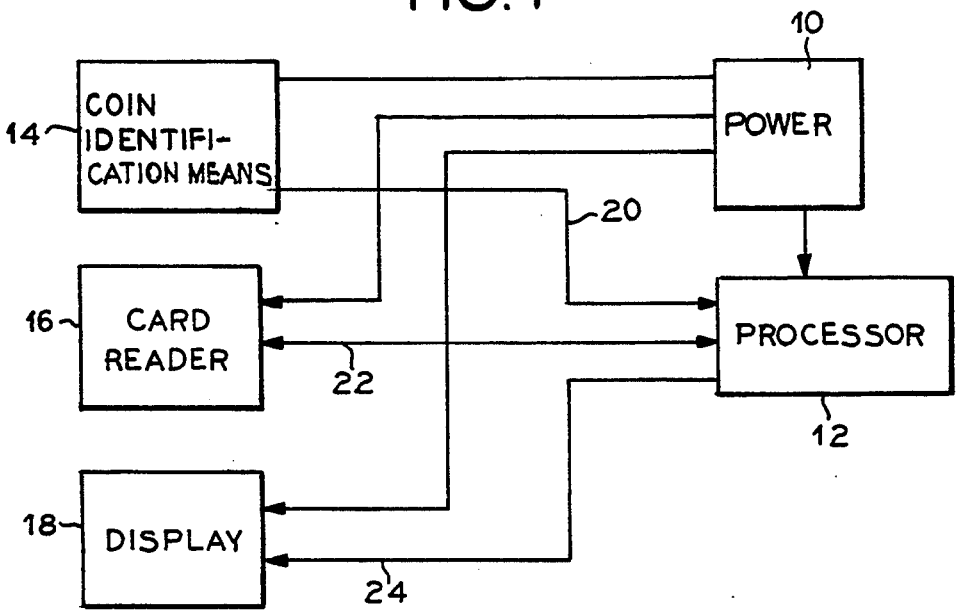
FIG. 1 is a block diagram of the electronic parking meter of the present invention.

It is an important feature of the present invention that the electronic parking meter conserves power. As depicted in FIG. 1, a power source 10, which may be a battery or capacitive element which is recharged by solar cells, is connected to a processor unit 12, coin identification means 14, card reader means 16, and display means 18. The processor unit 12 receives signals from the coin identification means 14 on line 20, interfaces with the card reader means 16 on line 22, and outputs data to the display means 18 on line 24. It is to be understood that the lines 20, 22 and 24 may represent a plurality of individual lines or buses.

Figure 2:
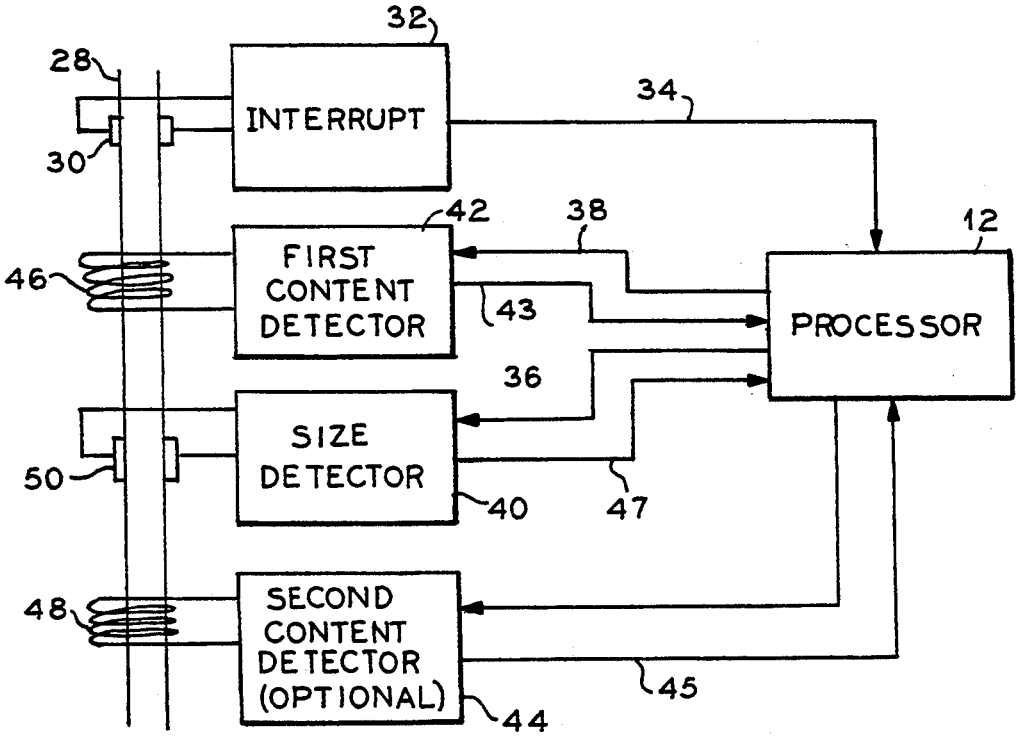
FIG. 2 is a block diagram of the coin chute and associated coin identifying means in the electronic parking meter.
Figure 3:
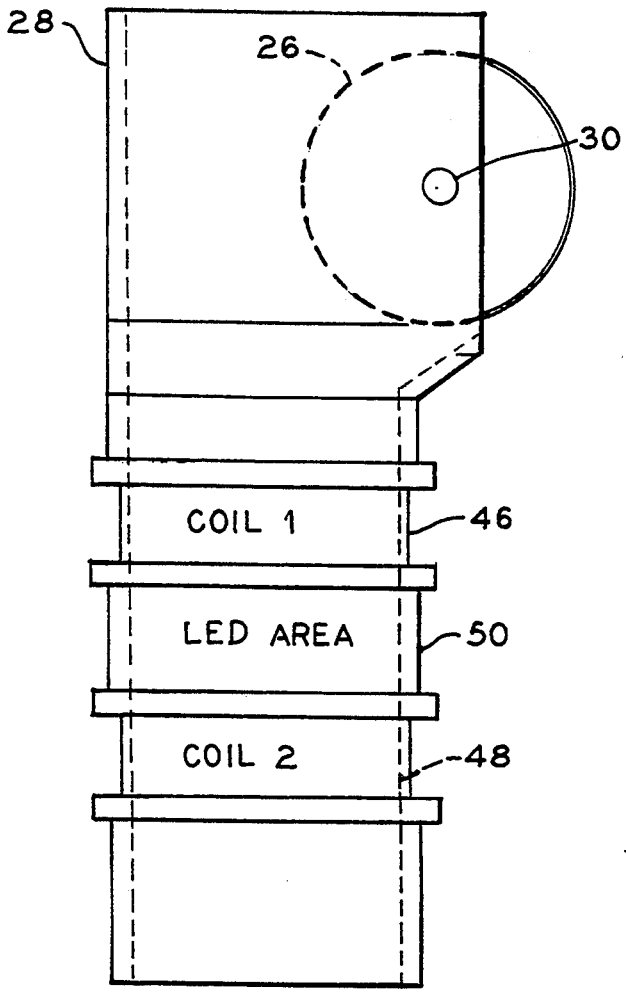
FIG. 3 is a side view of the coin chute.
Figure 4:
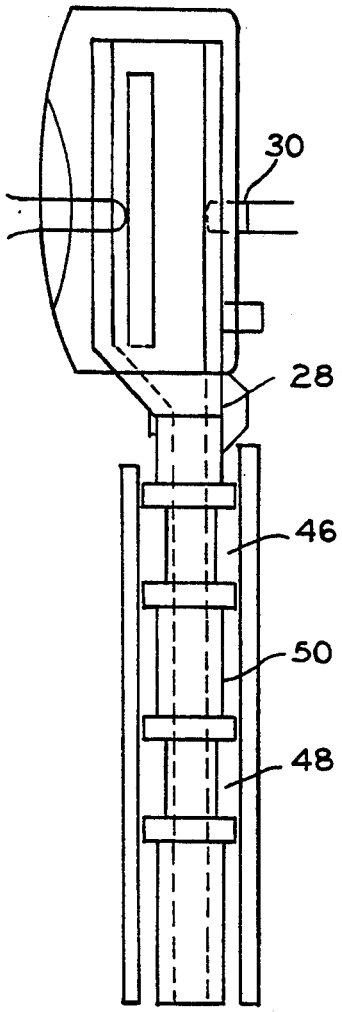
FIG. 4 is a front view of the coin chute.

The electronic parking meter conserves power by placing the processor unit 12 in a low power standby mode, the coin identification means 14 and the card reader means 16 in a mode such that they are substantially disconnected from the power source 10 when the electronic parking meter is substantially inactive. When a coin 26 is deposited in the electronic parking meter, the coin 26 falls in a free fall manner down a coin chute 28 (see FIGS. 2, 3 and 4). The coin 26 first passes an optical sensor 30 which is connected to an interrupt circuit 32 which in response sends an interrupt signal on line 34 to the processor unit 12. When the processor unit 12 receives the interrupt signal it sends signals on lines 36 and 38 to a size detector 40 and a first content detector 42 in the coin identification means 14. The coin identification means 14 can contain further content detectors such as second content detector 44. It has been found however, that it is sufficient in the United States to use only one content detector, such as first content detector 42, for a U.S. coin set comprising a quarter, a nickel, a penny and a dime. The content detectors 42 and 44 have coils 46 and 48, respectively, which are wound about the coin chute 28. The size detector 40 has a large area LED device 50 which is used to detect the size of the coin. The area LED device 50 is also mounted on the coin chute 28. It is to be noted that the order in which the detectors are mounted on the coin chute 28 is irrelevant. As the coin 26 falls past each of the coils 46, 48 and LED device 50 the corresponding content detectors 42 and 44 and the size detector 40 send signals to the processor unit 12 on lines 43, 45 and 47, respectively.

It is an important feature of the present invention that the coin 26 free falls down the coin chute 28, that is, it is not a requirement to establish a reference by having the coin ride along an edge of the coin chute as is done in the prior art. As will be described in more detail below the results obtained with the novel coin identification means 14 of the present invention is sufficient to differentiate between, for example, U.S. coins and counterfeit coin elements. Also, it should be noted that the time it takes for the coin to pass the optical sensor 30 is sufficient for the processor unit 12 to connect the content detectors 42, 44 and size detector 40 to the power source 10. The detectors are therefore considered to be in one of two states, that is, an active power state for sensing the coin 26 and a low power state when they are not being utilized. This provides a significant power savings for the electronic parking meter.

Figure 5:
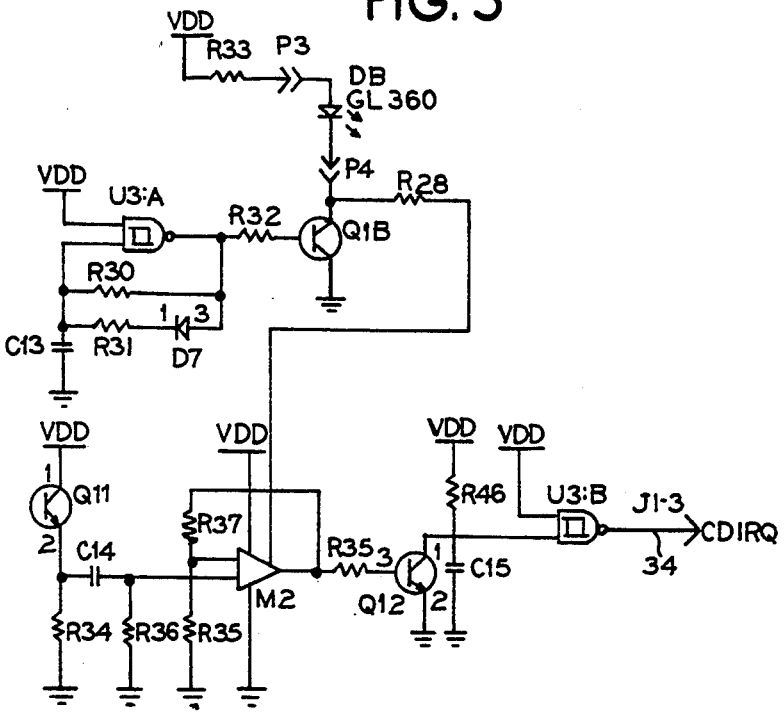
FIG. 5 is a circuit diagram of the interrupt circuit.

FIG. 5 depicts the circuit of the interrupt means 32. The voltage terminal "VDD" used in the drawings denotes the connection to the power source 10. Lighting emitting diode D8 is connected between the voltage VDD and ground by transistor Q18. A Schmidt trigger U3A controls the base of the transistor Q18 and pulses once every milisecond. The light from light emitting diode D8 is received by transistor Q11 and operational amplifier U2 which is connected to each of the light emitting diode D8 and the transistor Q11 and has an output connected through transistor Q12 to Schmidt trigger U3B. The circuit essentially forms a missing pulse detector which causes the Schmidt trigger U3B to change states when a missing pulse occurs. The missing pulse occurs when a coin interrupts the series of light pulses produced by the light emitting diode D8 and received by the transistor Q11. The missing pulse detector then causes a change in state of the Schmidt trigger U3B which cause the processor unit 12 to change from its standby mode to its operational mode. The light emitting diode D8 and the light receiving transistor Q11 form the optical sensor 30 in FIGS. 2, 3 and 4.

Figure 6:
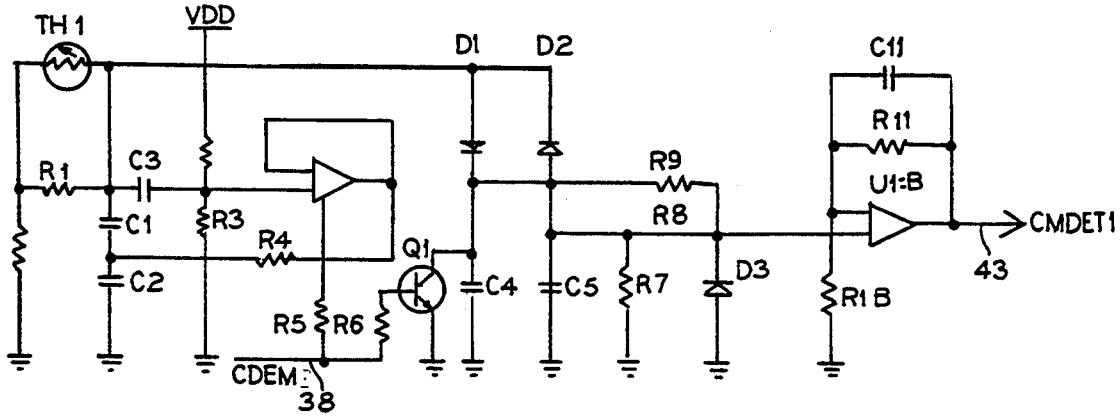
FIG. 6 is a circuit diagram of the content detector circuit.

FIG. 6 depicts a circuit schematic of the content detector (42 and 44). In the detectors 42, 44 the coils 46, 48 are each an inductor L1 that has a value of 8 millihenries in the preferred embodiment and is wrapped about the coin chute 28. Connected to inductor L1 is a thermistor TH1 which compensates for temperature changes. A free running oscillator which in the preferred embodiment operates at approximately 16 KHz is formed by operational amplifier U1A, resistors R1, R2, R3 and R4, capacitors C1, C2 and C3 and inductor L1, as well as, thermistor TH1. As the coin falls past the inductor L1 the oscillator is modulated. Diodes D1 and D2 essentially demodulate this signal and via operational amplifier U1B a signal indicative of the content of the coin is sent to the processor unit 12. The content detector is enabled by the processor unit 12, by a signal on line CDENB which activates operational amplifier U1A and transistor Q1 which is connected to the demodulating diodes D1 and D2. The output signal is sent on line CNDET1 and if the optional second content detector is utilized a second signal is sent on a line CNDET2.

The processor unit 12 samples the waveform appearing on line CNDET1 and extracts a peak amplitude value. This peak amplitude value is then compared to a stored reference peak value in the processor unit 12. If the measured peak amplitude value is within an acceptable window of the stored reference peak value (from either the first or second detector when two detectors are used) then the coin has been identified, at least as to metallic content, by the content detector.

In the preferred embodiment measured values for detected U.S. coins with regards to the content value are in the range of 500 to 1500. In the preferred embodiment, the processor unit 12 stores the following data:

U.S. quarter: 1,040–1,080;
U.S. nickel: 841–902;
U.S. penny: 689–746;
U.S. dime: 594–656.

It should be noted that the content values for each of the coins do not overlap. Thus, for example, if a quarter has a value of 1,070 it can be identified because it falls within the range of 1,040 to 1,080. Coins which do not fall within any of these ranges are considered to be non-acceptable.

FIG. 7 is a schematic circuit of the size detector 40. The processor unit 12 enables the size detector 40 by sending a signal on line CBENB which activates transistor Q9. When transistor Q9 conducts, light emitting diodes D9–D14 are energized and the area detector 50 is activated. Corresponding light receiving transistors Q3–Q8 in alignment with light emitting diodes D9–D14 are mounted on the coin shute 28.

FIG. 8 depicts the arrangement of the light receiving transistors Q3–Q8 (or correspondingly the light emitting diodes D9–D14). Transistors Q6, Q7 and Q8 are arranged in a first horizontal row 51 with regards to the direction of the coin falling through the coin shute 28 and the transistors Q3, Q4 and Q5 are arranged in a horizontal second row 53. The two rows are spaced apart by a distance D of three tenths of an inch and the individual elements of the first row and of the second row are spaced from one another by a distance of two tenths of an inch. When the coin 26 falls past (denoted by arrow 27) the transistors in the first row 51, as soon as any one of the three transistors is blocked from its corresponding light emitting diode the Schmidt trigger U3C is activated providing a signal on line SZDET1. Similarly when the coin falls past the second row 53 of transistors Q3, Q4, Q5, as soon as anyone of these transistors is blocked from its source of light, a second Schmidt trigger U3D is activated producing a signal on line SZDET2. Each of these lines SZDET1 and SZDET2 have a logic high value when no coin is present and go to a logic low value when the coin passes the corresponding row of light receiving transistors.

FIG. 9 depicts the two signals on lines SZDET1 and SZDET2. Signal S1 corresponds to the first horizontal row 51 depicted in FIG. 8 and signal S2 corresponds to the second horizontal row 53 depicted in FIG. 8. When the coin falls in the direction indicated by the arrow 27 past the first row 51, the triggering by anyone of the three detectors in the first horizontal row 51 causes the output signal S1 to change from a high to a low at time $T_1$. As the leading edge of the coin passes the second horizontal row 53, the second signal S2 changes from a high to a low value at time T2. As the trailing edge of the coin passes the horizontal row 51, the first signal S1 changes from a low value to a high value at time T3 and finally as the trailing edge of the coin passes the second row 53, the second signal changes from a low value to a high value at time $T_4$. Since the coin 26 accelerates as it falls down the shute 28, the speed of the coin entering the detector 50 is less than the speed of the coin leaving the detector. For example, the time from T1 to T2 can be 5 miliseconds, the time from T2 to T3 can be 10 miliseconds and the time from T3 to T4 can be 3 miliseconds. The processing unit 12 uses the signals S1 and S2 to calculate a coin speed entering the detector 50, that is related to the difference of times T1 and T2 and a coin speed leaving the detector 50 which is related to the difference of times T3 and T4. The difference of times T2 and T3 is defined to be a "cord length" of the coin. The processing unit 12 adds the ratio of the cord length to the speed entering the detector to the ratio of the cord length to the speed leaving the detector. This final "size" value representative of the coin is compared to stored ranges of values. The processor unit 12, for example, for a U.S. coin set has the following "size" values stored:

U.S. quarter: 150–163;
U.S. nickel: 20–50;
U.S. penny: 50–141;
U.S. dime: 23–35.

If a size value falls within the windows of the U.S. coin set, the processing unit 12 has identified the corresponding coin. Finally, it is to be noted that full identification of the deposited coin is established when both the size value falls within one of the acceptable windows for size values and when the content value falls within one of the corresponding acceptable windows for the content values of the acceptable coins.

Figure 10:
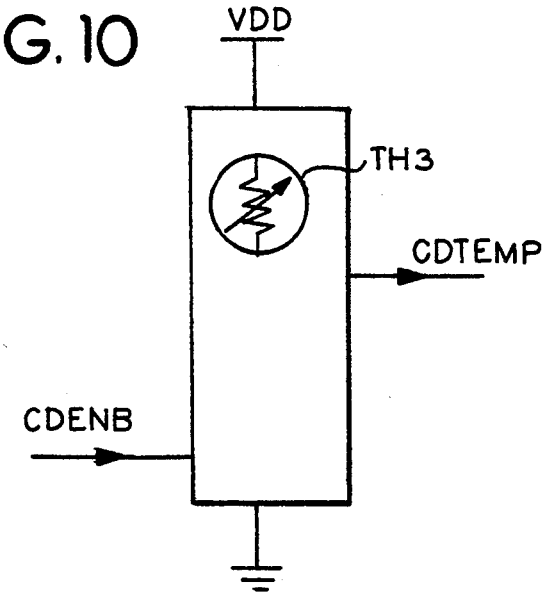
FIG. 10 is a circuit diagram of the temperature compensation circuit.

FIG. 10 depicts a circuit of a thermistor TH3 that is connected to the CDEMB enabled signal line and that outputs a compensation signal for temperature variations of the electronic parking meter on line CDTEMP.

Figure 11:
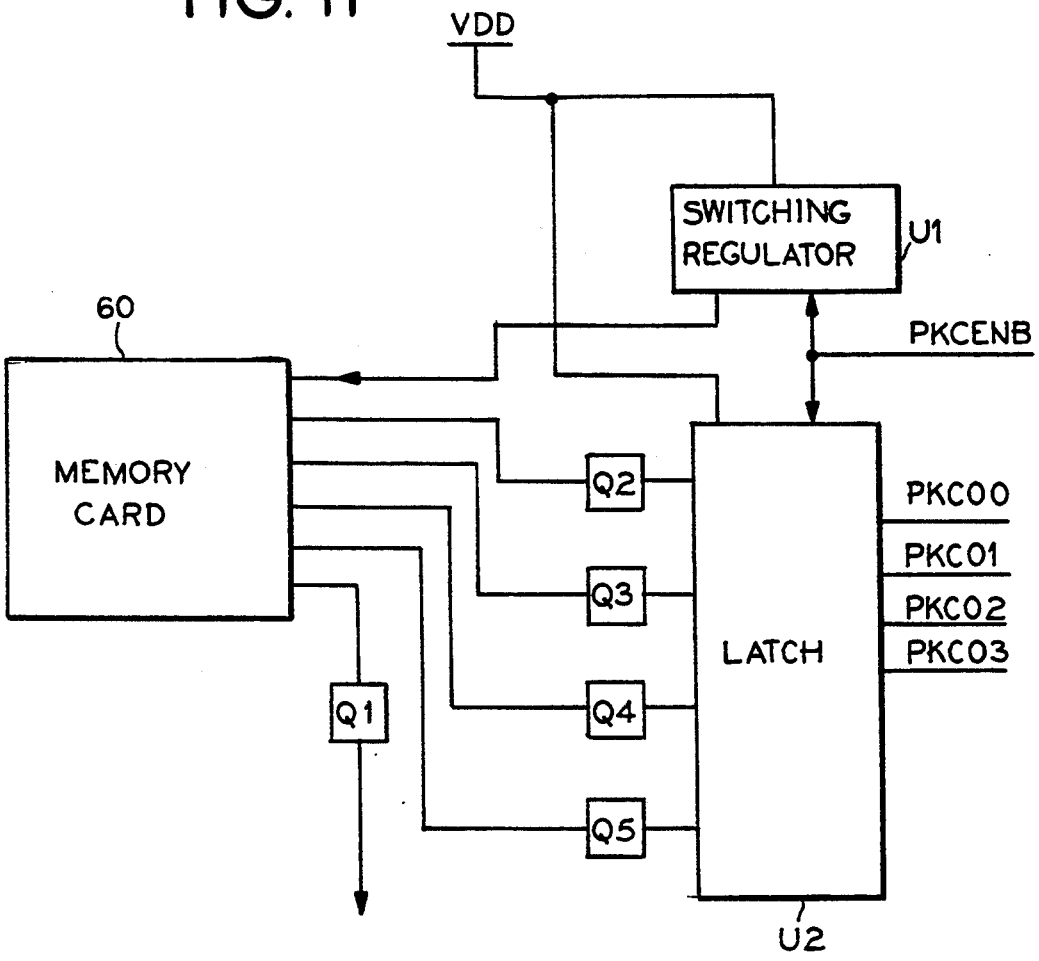
FIG. 11 is a circuit diagram of the card reader interface circuit.

FIG. 11 is a schematic diagram of the card interface of the card reader means 16 which receives the memory card 60. Insertion of the card 60 activates transistor Q1 and produces a interrupt request signal on line PKCIRQ. Thus, similar to the operation of the coin identification means 14 the processor unit 12 sends an enable signal on the line PKCENB back to the card reader means 16 thereby changing the state of the card reader means 16 from a low power mode to an active mode. The line PKCENB is connected to a switching regulator U1 and a four bit latch U2. Activation of the switching regulator U1 provides the five volts necessary for operation of the card 60 from the three volts in the electronic parking meter, and the four bit latch U2 connects the microprocessor outputs PKCO0-PKCO3 to level translators Q3, Q4, Q5 and Q2. Lines PKCI0 and PKCI1 connect to inputs of the microprocessor in the processor unit 12. It is an important part of the present invention that the interface saves power by being placed in a low power mode, that is, the switching regulator U1 and the four bit latch U2 are disconnected from their power supply when the card reader means 16 is not utilized.

Figure 12C:
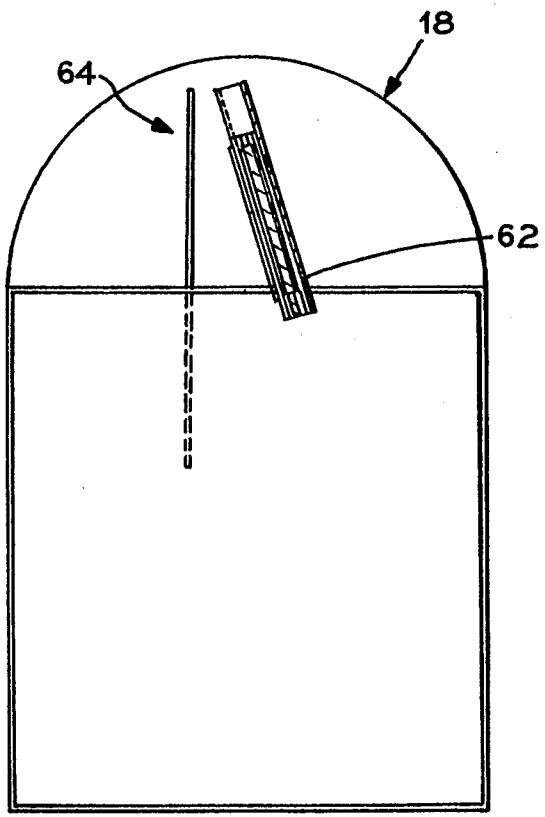
FIGS. 12A, 12B and 12C are front, rear and side views, respectively, of the electronic parking meter showing the display means.
Figure 12B:
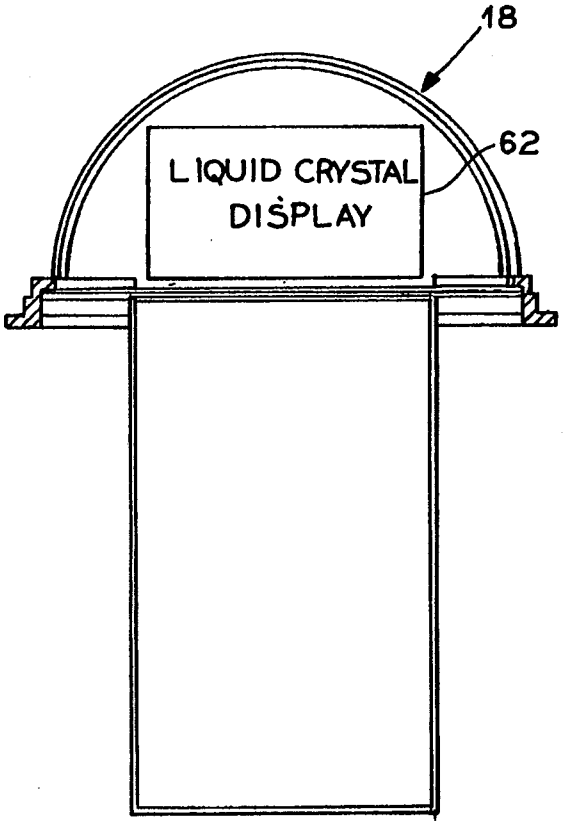
Figure 12A:
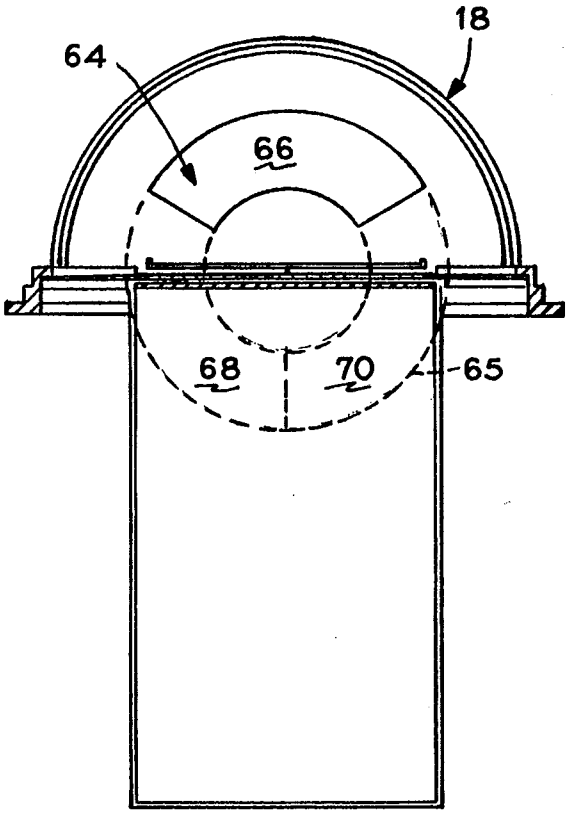

FIGS. 12*a*, 12*b* and 12*c* show respective front, rear and side views of the display means 18 of the electronic parking meter. In the rear view depicted in FIG. 12*b*, the display is a liquid crystal display 62 and in the front view of FIG. 12*a*, the display is a high visibility flag means 64. It a feature of the present invention as shown in the side view of FIG. 12*c* that the LCD display 62 is tilted back from a vertical position by approximately 20 degrees. This provides ease of viewing by a person standing next to the meter since typically the parking meter is mounted at a height which is lower than the height of a normal person. Since LCD displays are difficult to view unless viewed "straight-on" the tilted LCD display 62 provides a significant improvement over the vertically orientated displays of the prior art.

Figure 13:
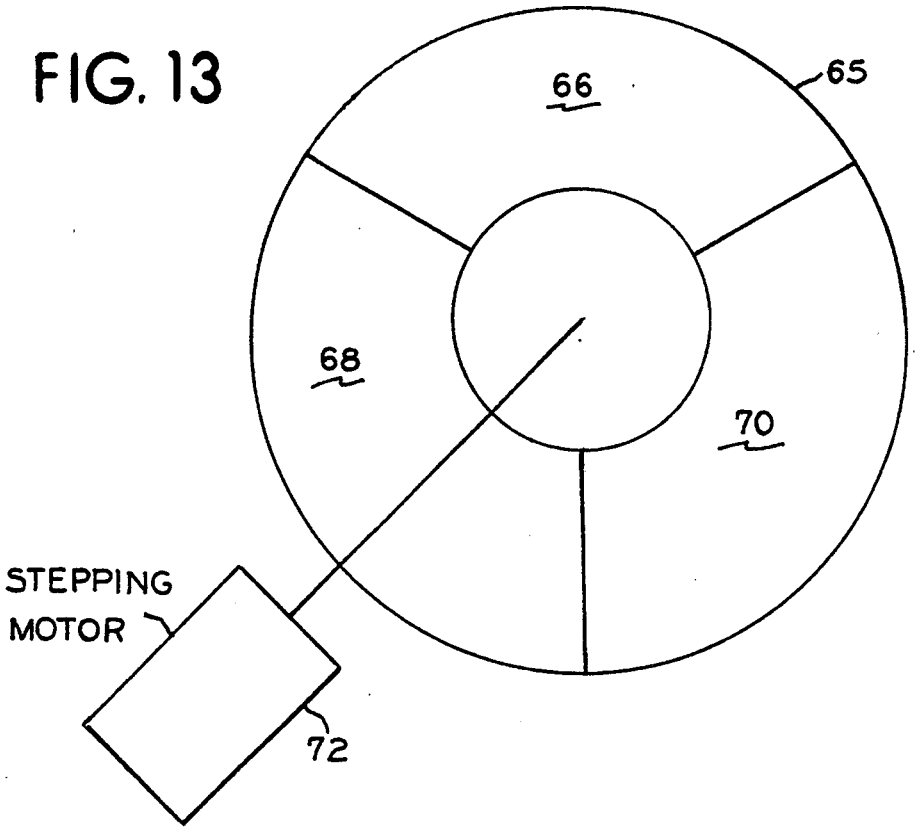
FIG. 13 depicts a portion of the display means.
Figure 14:
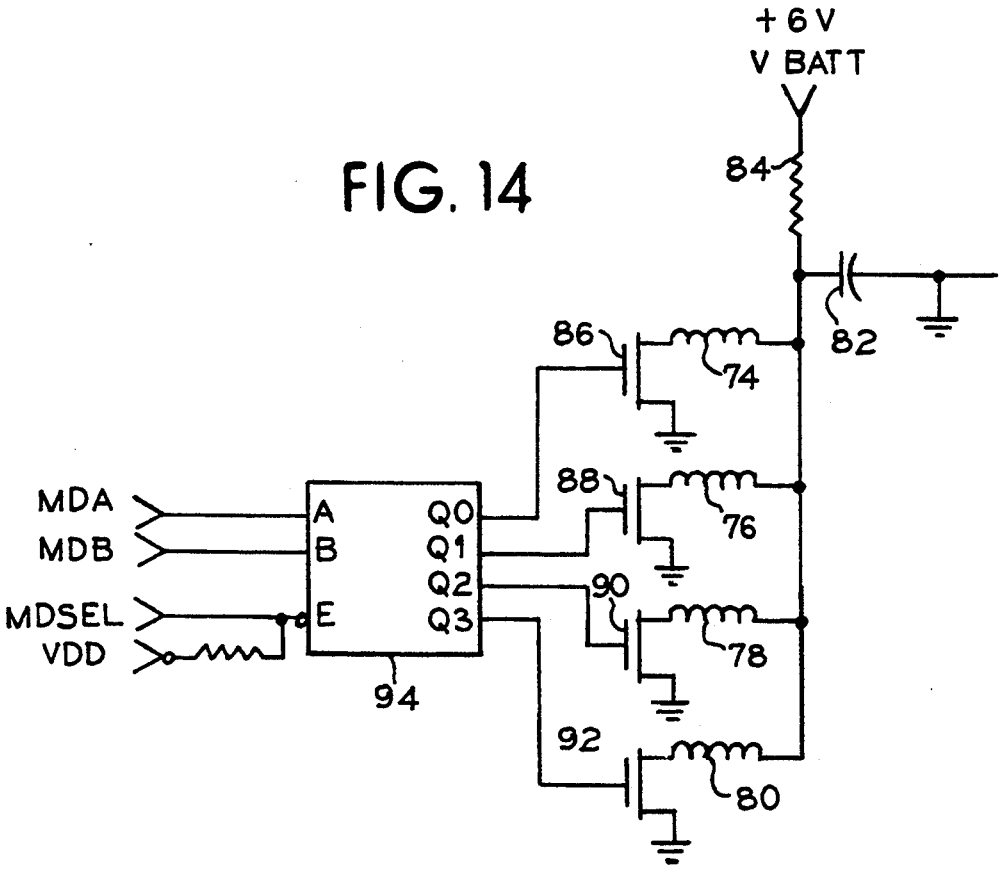
FIG. 14 is a circuit diagram of the stepper motor drive circuit for the FIG. 13 display.
Figure 15A:
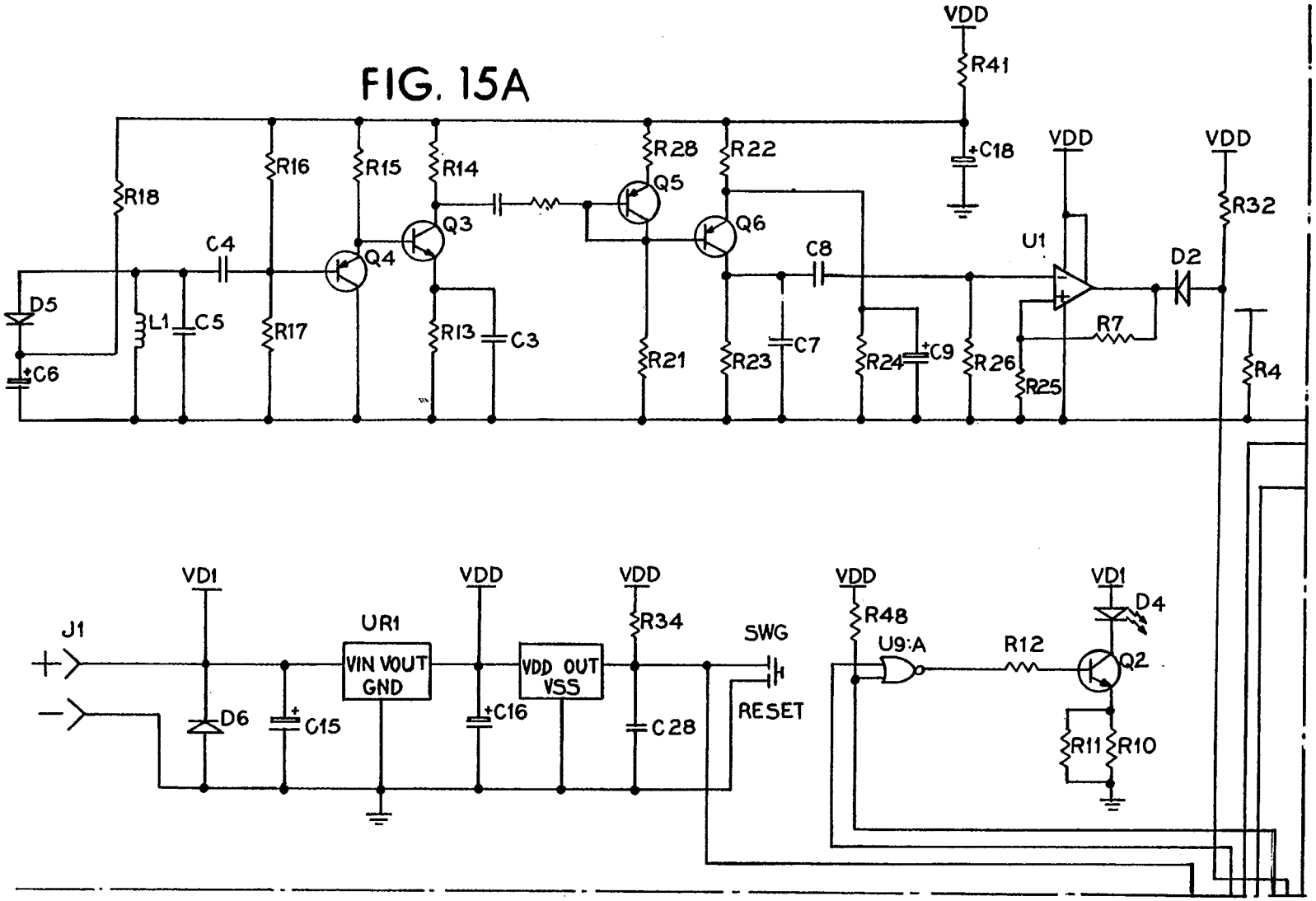
FIGS. 15A–15D show a circuit diagram of a further portion of the electronic parking meter.
Figure 15B:
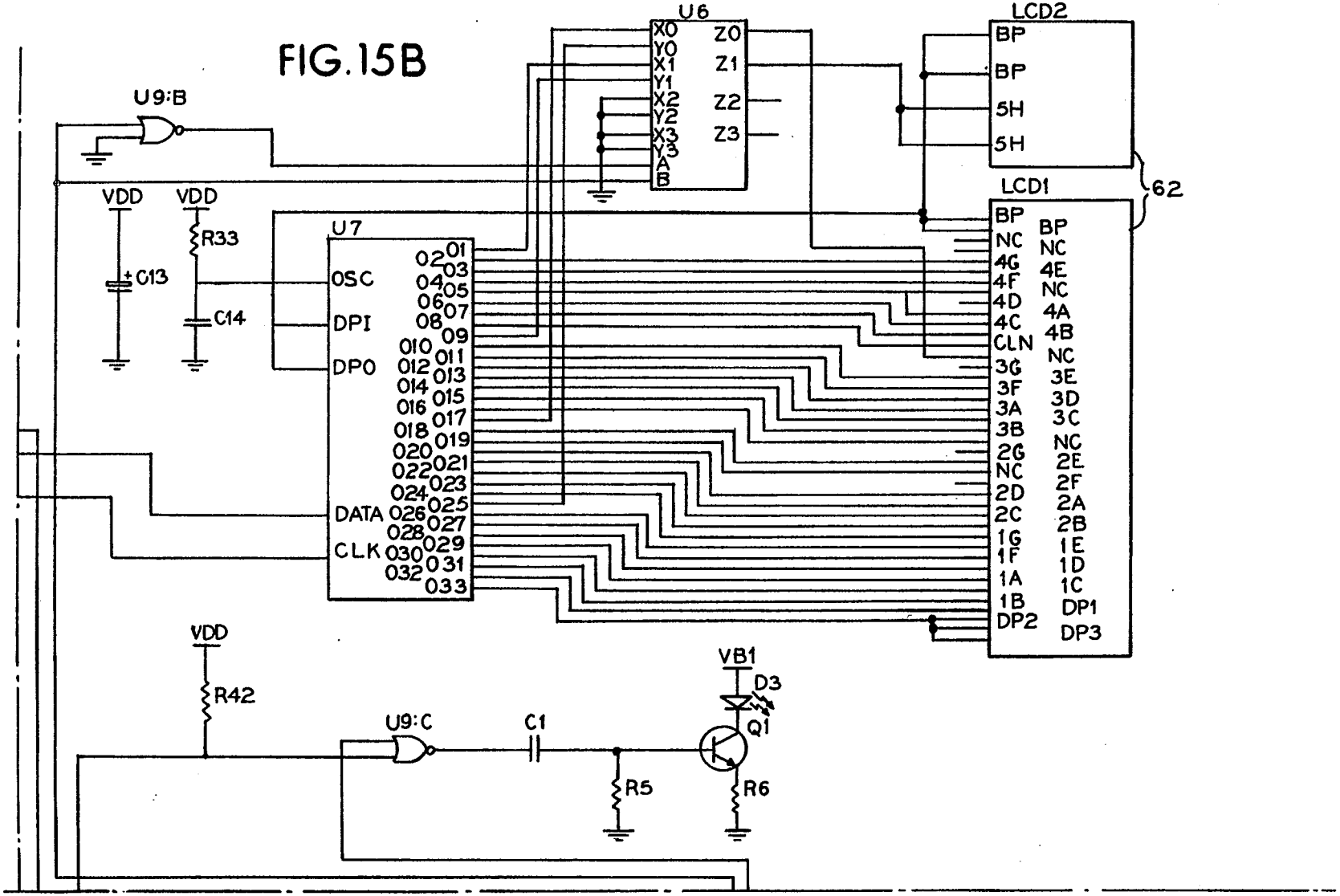
Figure 15C:
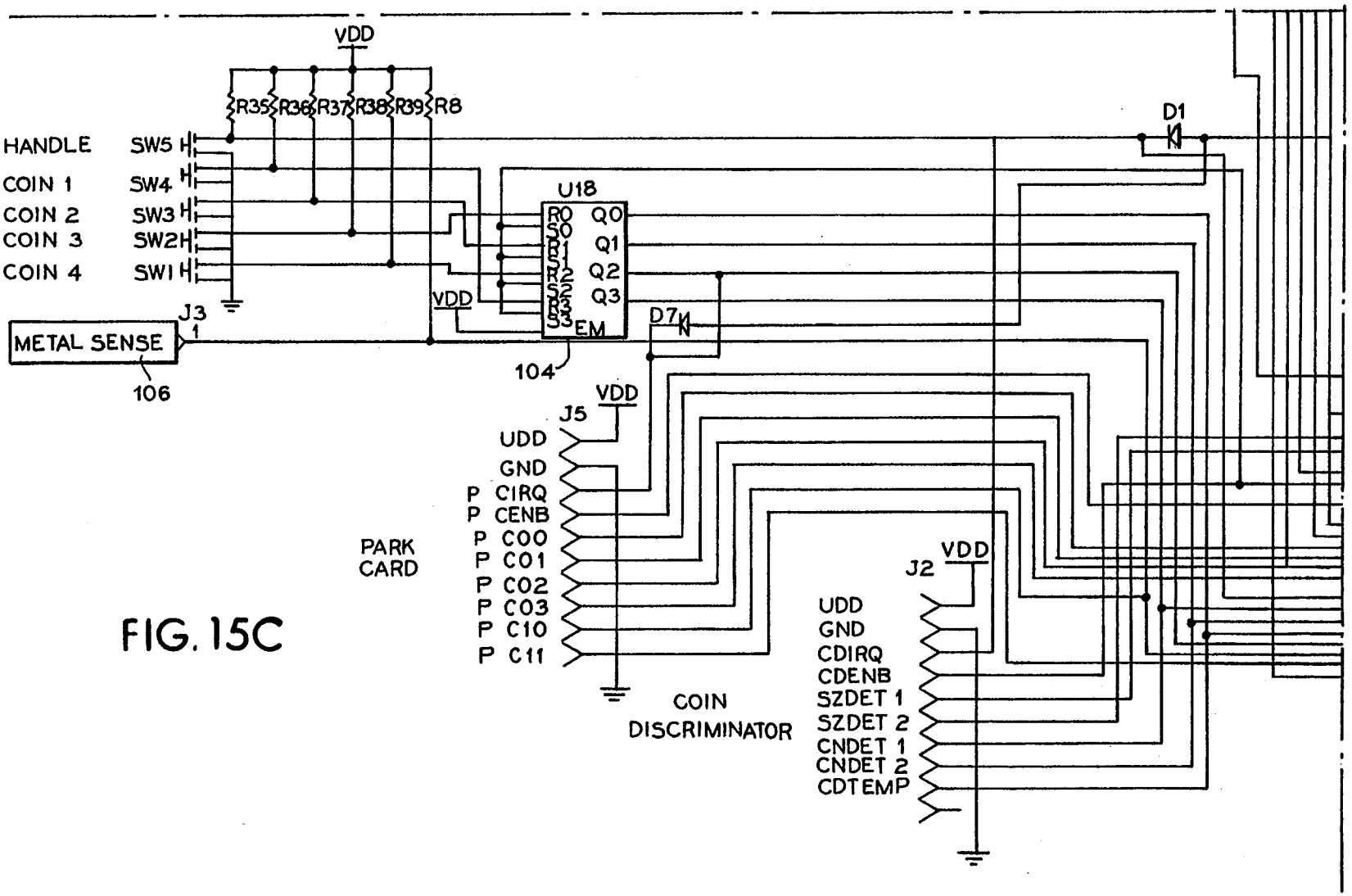
Figure 15D:
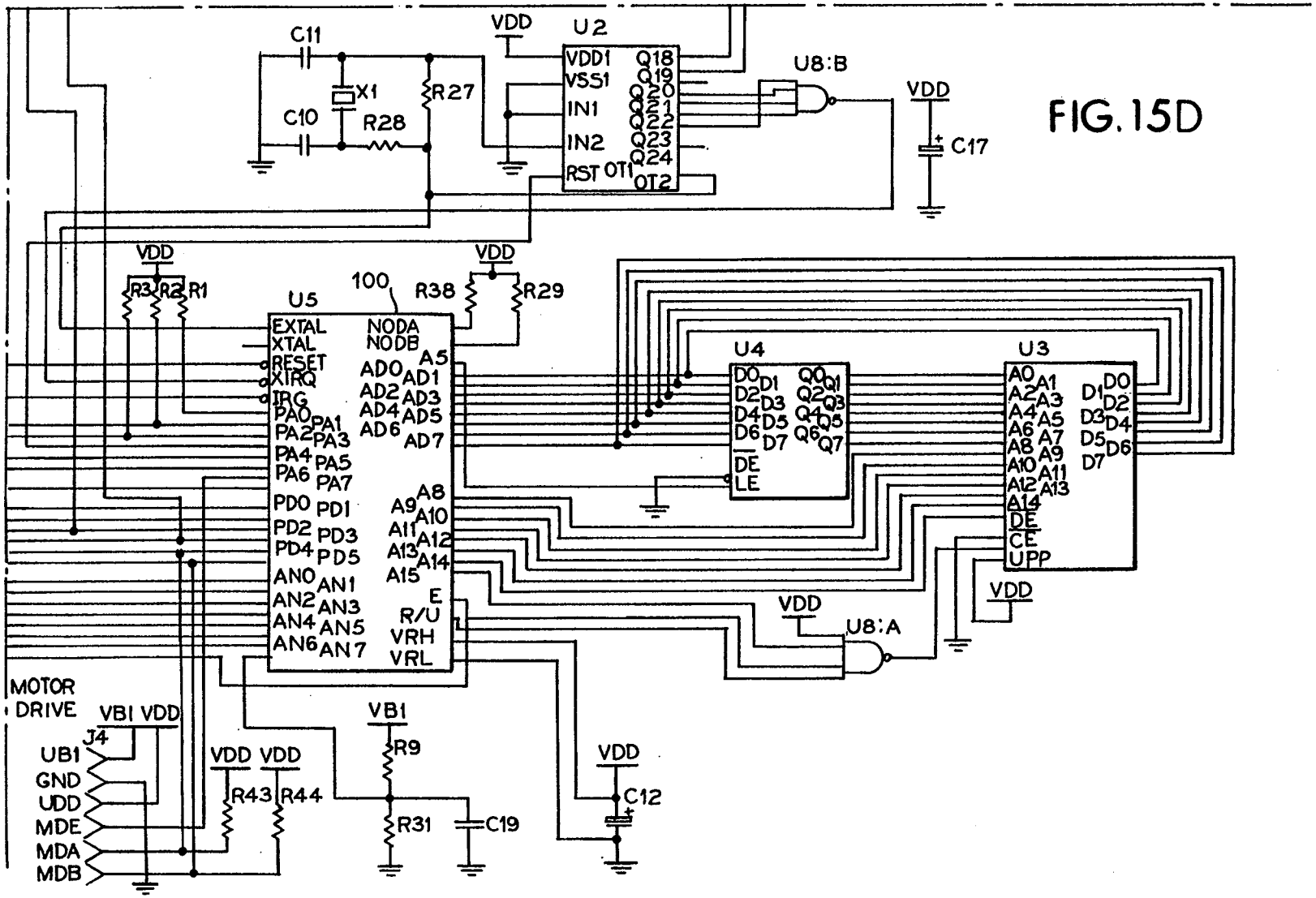

In the preferred embodiment the flag means 64 has a disk 65 which is divided into three areas 66, 68 and 70. In the preferred embodiment the area 66 is colored red and indicates a time expired condition of the meter. The area 68 is colored yellow and indicates that an error has occurred in the meter. Finally, the area 70 is colored silver and indicates that the meter is presently activated and counting time. As shown in FIG. 13 the disk 65 of the flag means 64 is rotated by a stepping motor 72. The circuit diagram shown in FIG. 14 provides for a significant power conservation feature in that the stepping motor 72 which has four coils 74, 76, 78 and 80 is powered by a stored voltage on capacitor 82. Capacitor 82 is recharged slowly through resistor 84 that is connected to the power source 10 (in a preferred embodiment 6 volts is connected to the resistor 84). The coils 74, 76, 78 and 80 of the stepping motor 72 are controlled by a power MOSFETS 86, 88, 90 and 92, via demultiplexer 94. The microprocessor in the processor unit 12 provides motor drive control signals on lines MDA and MDB to the demultiplexer 94. The energizing signal on line MDSEL is provided by the processor unit 12 such that in conjunction with the motor drive signals the stepping motor 72, is activated to turn the disk 65 of the flag means 64 to orientate one of the three display areas 66, 68 or 70 in a viewing area of the electronic parking meter. It is to be noted that upon power up the processor unit 12 causes the disk 65 of the flag means 64 to be rotated to a stop position in order to synchronize the position of the flag means 64 with the processing unit 12.

Power to drive the stepping motor 72 is provided by the capacitor 82 rather than directly by the power source 12. This provides that, for example if the power source 12 is a battery, a smaller battery can be utilized since the high current demands at a momentary time are only required of the capacitor and not the battery. Recharging of the capacitor 82 occurs therefore at a slower rate and at a lower current level. This permits a lower average current to be drawn from the power source 10 in the present embodiment.

FIG. 15A–15D depicts the circuitry for the remainder of the electronic parking meter, including the processor unit 12, and indicates the connection to a microprocessor 100 of the card reader means 16, the coin identification means 14 and the stepping motor drive in the display means 18. Microprocessor 100 is also connected to LCD displays 62 via interface 102.

An option which is also depicted in FIG. 15A–15D is the connection to the microprocessor 100 via interface 104 to handle and coin switches SW1–SW5 and metal sense device 106, which are disclosed in U.S. patent application Ser. No. 622,612 filed Dec. 5, 1990, allowed on Feb. 20, 1992, and hereby incorporated by reference. Typically, the switches SW1–SW5 and the metal sense device 106 would be utilized as an alternative to the coin identification means 14.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A power conserving electronic parking meter system for receiving at least one type of payment element, comprising:

the payment element being a coin;

a coin chute having a free-fall section through which the coin falls;

means for providing power;

means for processing connected to said means for providing power, said means for processing having at least an operational mode and a standby mode;

means for receiving the coin and generating an interrupt request signal upon receipt of the coin, the interrupt request signal being received by the means for processing which in response thereto changes from said standby mode to said operational mode, said means for receiving having means for sensing coupled to said free-fall section of said coin chute for detecting the coin as the coin falls past said means for sensing;

at least one means for identifying the coin and providing an identification signal to said means for processing indicative of the coin, said means for identifying having an active mode and a low-power mode, said at least one means for identifying receiving an enable signal from said means for processing when said means for processing changes from said standby mode to said operational mode, said enable signal causing said means for identifying to change from said low-power mode to said active mode, said at least one means for identifying being coupled to said free-fall section of said coin chute; and means for displaying information connected to said means for processing, said means for displaying having means for reduced power display, said means for displaying having a rotatable disk connected to a stepping motor, said rotatable disk having a plurality of flag areas each of which may be rotated into a viewable area of said means for displaying by said stepping motor, said stepping motor receiving motor control signals from said means for processing and receiving power substantially from a stored charge on a capacitor;

wherein said at least one means for identifying is coupled to said free-fall section below said means for receiving, and wherein said coin substantially free-falls past said means for sensing of said means for receiving and substantially free-falls past said at least one means for identifying.

2. The power conserving electronic parking meter system according to claim 1, wherein said means for sensing of said means for receiving comprises an optical sensor means for sensing an insertion of the coin into the free-fall section of said coin chute, and wherein said means for receiving further comprises an interrupt circuit means connected to said optical sensor means for generating said interrupt request signal.

3. The power conserving electronic parking meter system according to claim 1, wherein said capacitor is connected to said means for providing power such that said capacitor is charged at a current rate that is less than a current rate used to operate said stepping motor.

4. The power conserving electronic parking meter system according to claim 1, wherein said means for displaying information has a liquid crystal display.

5. The power conserving electronic parking meter system according to claim 4, wherein said liquid crystal display and said rotatable disk are visible on opposed sides of a housing of the electronic parking meter system.

6. The power conserving electronic parking meter system according to claim 4, wherein said liquid crystal display is tilted approximately 20° back from a vertical orientation.

7. The power conserving electronic parking meter system according to claim 1, wherein said at least one means for identifying comprises size detector means for detecting a size of the coin and generating size signals indicative thereof, and at least one content detector means for detecting a content of the coin and generating a content signal indicative thereof, said size detector means and said at least one content detector means being connected to said free-fall section of said coin chute.

8. The power conserving electronic parking meter system according to claim 7, wherein a range of acceptable size values and a range of acceptable content values are stored in the means for processing and wherein said means for processing identifies a coin by comparing values derived from the size signals and the content signal, respectively, to the ranges of acceptable stored size values and stored content values, a coin being accepted as valid if the size signals and the content signal are associated with values that lie within respective ranges of the stored size values and stored content values.

9. The power conserving electronic parking meter system according to claim 7, wherein said at least one content detector means has a free running means for oscillating having a coil that surrounds a portion of the free-fall section of the coin chute, means for demodulating having an input connected to an output of the means for oscillating and having an output for providing said content signal, and means for enabling said means for oscillating and said means for demodulating in response to receiving said enable signal.

10. The power conserving electronic parking meter system according to claim 9, wherein said content signal is a waveform signal that is sampled by said means for processing to extract a peak value of said waveform signal, said means for processing comparing said peak value with at least one range of stored acceptable values to identify an acceptable coin, the coin being acceptable when said peak value falls within said range.

11. The power conserving electronic parking meter system according to claim 7, wherein said size detector means has at least one first optical sensing means in spaced relation to at least one second optical sensing means, said first and second optical sensing means attached to a portion of said free-fall section of said coin chute, means for generating said size signals connected to said first and second optical sensing means, and means for enabling said first and second optical sensing means in response to receiving said enable signal.

12. The power conserving electronic parking meter system according to claim 11, wherein a leading edge of a coin falling past the first and second optical sensing means produces first and second leading signal edges and a trailing edge of said coin produces first and second trailing signal edges, said means for processing deriving a size value according to $$\frac{C}{A} + \frac{C}{B} = \text{size value}$$

where A corresponds to the difference between the first leading signal edge and the first trailing signal edge, where B corresponds tot he difference between the second leading signal edge and the second trailing signal edge, where C corresponds to the difference between the first trailing signal edge and the second leading signal edge.

13. The power conserving electronic parking meter system according to claim 11, wherein said at least one first optical sensing means is a first row of optical sensors and said at least one second optical sensing means is a second row of optical sensors, said first and second rows being spaced a predetermined distance apart and oriented substantially perpendicular to a direction of fall of a coin in said coin chute.

14. The power conserving electronic parking meter system according to claim 13, wherein each of said optical sensors has a light emitting diode and a light activated transistor mounted on opposing sides of said coin chute.

15. The power conserving electronic parking meter system according to claim 13, wherein each of said first and second rows have at least three optical sensors spaced a predetermined distance apart.

16. A power conserving electronic parking meter system for receiving at least one type of payment element, comprising:

means for providing power;

means for processing connected to said means for providing power, said means for processing having at least an operational mode and a standby mode;

means for receiving the payment element and generating an interrupt request signal upon receipt of the payment element, the interrupt request signal being received by the means for processing which in response thereto changes from said standby mode to said operational mode;

at least one means for identifying the payment element and providing an identification signal to said means for processing indicative of the payment element, said means for identifying having an active mode and a low-power mode, said at least one means for identifying receiving an enable signal from said means for processing when said means for processing changes from said standby mode to said operational mode, said enable signal causing said means for identifying to change from said low-power mode to said active mode; and means for displaying information connected to said means for processing, said means for displaying having means for reduced power display; said means for displaying also having a rotatable disk connected to a stepping motor, said rotatable disk having a plurality of flag areas each of which may be rotated into a viewable area of said means for displaying by said stepping motor, said stepping motor receiving motor control signals from said means for processing and receiving power substantially from a stored charge on a capacitor.

17. The power conserving electronic parking meter system according to claim 16, wherein said capacitor is connected to said means for providing power such that said capacitor is charged at a current rate that is less than a current rate used to operate said stepping motor.

* * * * *